US006945365B2

(12) United States Patent
Matela

(10) Patent No.: US 6,945,365 B2
(45) Date of Patent: Sep. 20, 2005

(54) METHOD FOR ALLOCATING PASSENGERS TO AN ELEVATOR

(75) Inventor: Mika Matela, Lahti (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 10/879,191

(22) Filed: Jun. 30, 2004

(65) Prior Publication Data

US 2005/0029054 A1 Feb. 10, 2005

Related U.S. Application Data

(63) Continuation of application No. PCT/FI03/00144, filed on Feb. 28, 2003.

(30) Foreign Application Priority Data

Mar. 5, 2002 (FI) ..... 20020425

(51) Int. Cl.[7] ..... B66B 1/18

(52) U.S. Cl. ..... 187/382; 187/247; 187/902; 706/910

(58) Field of Search ..... 187/247, 281, 187/380–387, 902, 903, 910; 706/13, 21, 23, 902, 903, 910

(56) References Cited

U.S. PATENT DOCUMENTS

| | | | | | |
|---|---|---|---|---|---|
| 4,993,518 | A | * | 2/1991 | van Straaten et al. | 187/387 |
| 5,625,176 | A | * | 4/1997 | Davis et al. | 187/393 |
| 5,689,094 | A | | 11/1997 | Friedli et al. | |
| 6,065,570 | A | | 5/2000 | Friedli et al. | |
| 6,176,351 | B1 | * | 1/2001 | Ikeda et al. | 187/387 |
| 6,293,368 | B1 | * | 9/2001 | Ylinen et al. | 187/382 |
| 6,401,874 | B2 | * | 6/2002 | Siikonen | 187/382 |
| 6,419,051 | B2 | * | 7/2002 | Mori et al. | 187/382 |
| 6,508,333 | B2 | * | 1/2003 | Kostka et al. | 187/382 |

* cited by examiner

*Primary Examiner*—Jonathan Salata
(74) *Attorney, Agent, or Firm*—Birch, Stewart, Kolasch & Birch, LLP

(57) ABSTRACT

A method for the allocation of passengers in an elevator group. The group has several elevator lobbies and multi-door elevators. Each passenger gives his/her destination floor by means of a call input device, so that the passenger's starting and destination floors are thereby defined.

11 Claims, 2 Drawing Sheets

METHOD FOR ALLOCATING PASSENGERS TO AN ELEVATOR

This application is a Continuation of co-ending PCT International Application No. PCT/FI03/00144 filed on Feb. 28, 2003, which designated the United States, and on which priority is claimed under 35 U.S.C. §120. This application also claims priority under 35 U.S.C. §119(a) on Patent Application No (s). 20020425 filed in Finland on Mar. 5, 2002. The entire contents of each of the above documents is hereby incorporated by reference.

BACKGROUND OF THE INVENTION

1. Field of the Invention

The present invention relates to a method for the allocation of passengers in an elevator group comprising multi-door elevators.

2. Discussion of the Background

Prior art is described in Finnish patent application FI-A-20000502 (B66B 1/18), which discloses a solution relating to the allocation of passengers to the elevators in an elevator bank. In this passenger allocation solution, each passenger gives his/her destination floor. The starting floor being known on the basis of the location of the call input device, it is possible to obtain unambiguous information regarding passengers trying to get onto the system. With these initial data, the elevator group control is able to find a preferable elevator for each passenger. This is called passenger allocation.

In this solution, the decision making is based on e.g. genetic algorithms. First, a number of alternative solutions, i.e. chromosomes are created, the quality of which as allocation decisions is determined. After this, the set of alternative solutions is subjected to refinement by genetic methods, which include the selection of representative solution alternatives for the next generation and as parents for descendants, the generation of descendants, i.e. new solution alternatives, by crossbreeding the best solution alternatives of each instant with each other and/or by applying changes or mutations to the genes of the descendants created. A quality factor has to be determined for each descendant, whereupon the next generation of solution alternatives can be created or, if a termination criterion is fulfilled, the best alternative in the set of solutions is selected as the solution to the problem. Without a genetic algorithm, the best solution is found by a heuristic method e.g. by finding a routing alternative that minimizes the call time and using a prior-art technique, which is described in US patent specification 5616896 (B66B 1/42).

In genetic passenger allocation, the subject considered is expressly the passengers, in other words, a decision is made as to which elevator car is to serve each passenger. Each passenger gives his/her destination floor using a call input device on the starting floor, and thus the data for each passenger is known in the elevator system. The elevator system also has to inform each passenger as to which elevator is going to serve him/her. Once the passenger has been thus informed, it is no longer possible to change the elevator car offered to him/her.

US patent specification 5689094 (B66B 1/20) again discloses an elevator group comprising passenger terminals located on each floor. In the elevator group described in this specification, destination calls can be entered from the aforesaid passenger terminals via input means, which may consist of e.g. a keyboard. Information regarding allocated elevators is presented to the user on a display device placed at the aforesaid passenger terminal immediately after a destination call has been given. A second display is provided above the landing door to tell the passenger which elevator car will serve the desired floor.

A problem with the prior-art solutions is that a given elevator car is always definitively assigned to serve a given call entered by a passenger in the elevator group. Therefore, the elevator control system can not later change the elevator assigned to a given call. On the other hand, in the case of a multi-car elevator group comprising several lobbies, it does not make any great difference to the passenger which elevator car is going to serve him/her. In addition, it may be difficult for the passenger to distinguish the elevator car assigned to a given call.

Also, the problems related to immediate allocation of calls in the traditional up/down button group control are not directly comparable with the problems of immediate allocation in the case of destination allocation, which is due to the fact that, in destination allocation, information regarding the destination of an individual passenger is obtained immediately in connection with the hall call and the passenger can not influence the formation of the route of his/her elevator trip.

SUMMARY OF THE PRESENT INVENTION

The object of the present invention is to overcome the drawbacks observed in the above-mentioned prior-art solutions.

As compared with prior art, the present invention provides several advantages.

The invention provides an advantage in that the group control system of the elevator group, comprising lobby and door allocation, is better adaptable to the needs of the elevator group control system because it is not necessary to immediately allocate calls definitively to a given elevator car. Likewise, the use of multi-door elevator cars reduces the stopping times of the elevators because passengers can use either door, and preferably the one closer to himself/herself, to enter the elevator.

A significant advantage achieved by the invention is that the elevator lobby allocation method of the invention reduces congestion in elevator lobbies because passengers are allocated to different lobbies in a balanced way. Likewise, lobby allocation increases the time available for computation in the group control of the elevator group.

In addition, the use of elevators preferably comprising several doors enhances the operation of efficient genetic algorithms in the group control of the elevator group because the search space for potential different solutions is increased and it is thus also possible find better elevator route solutions.

Another advantage achieved by the invention is that the passenger can be more easily guided from a call input device to an elevator lobby than to an individual elevator car. To guide passengers to the allocated elevator lobby, it is possible to use e.g. international arrow symbols.

In particular, the invention concerns a method for the allocation of passengers in an elevator group comprising many waiting lobbies and multi-door elevators, in which method each passenger gives his/her destination floor via a call input device, the passenger's starting and destination floors being defined as a given starting floor, which may be a lower lobby or an upper lobby or a floor for a change of elevators in a skyscraper in the case of shuttle elevators or one of the floors between lobby floors in the case of local elevators. In skyscrapers, the aforesaid floors with elevator lobbies are generally called lobby floors, for example an upper lobby is called a sky lobby floor. According to the best embodiment of the invention, when a passenger gives a destination floor call, an elevator lobby is allocated first, whereupon an elevator door is allocated.

According to another embodiment of the invention, if the passenger is to be served by a multi-deck elevator car, the elevator to serve the passenger's call is allocated after the allocation of the elevator door.

According to another embodiment of the invention, the passenger is allocated to the elevator car that is to serve him/her by a genetic allocation method by encoding the elevator routes into alternative chromosomes, the required data regarding the elevator lobbies and elevator doors and elevator cars for the passenger being stored in a gene of the chromosome. In addition, utilizing genetic methods, alternative chromosomes are developed and the best one among these is selected, besides which the passengers indicated by the best chromosome are guided to the elevator lobbies and elevator doors and elevator cars represented by the best chromosome, while the elevator lobbies and elevator doors and elevator cars indicated by the best chromosome are caused to serve the passengers stored on the chromosome.

Similarly, according to an embodiment of the invention, the chromosomes are so formed that the position of the gene in the chromosome defines the identity of the passenger, and the value, or allele, of the gene defines the elevator lobby and elevator door and elevator car to serve the passenger.

According to an embodiment of the present invention, the gene contains several allele alternatives as long as the genetic algorithm is running.

According to the invention, the elevator lobbies and elevator doors and elevator cars assigned to passengers during previous allocation cycles are stored on a chromosome as genes whose allele is unchangeable and represents the elevator lobby and elevator door and elevator car already allocated to the passenger.

According to the invention, genetic allocation is performed in a GA kernel, from where an executive unit obtains the elevator lobby and elevator door and elevator car selected for the passenger, who will be guided as a passenger allocated to an elevator having this elevator lobby and elevator door and elevator car.

According to an embodiment of the present invention, after the genetic algorithm has stopped, the executive unit calls a decoding function, whereby the elevator lobbies and elevator doors and elevator cars indicated by the best chromosome are obtained from the GA kernel, to be entered into the elevator data fields for unallocated passengers.

According to the present invention, two or more passengers can be handled together by a single passenger group gene.

According to a preferred embodiment of the present invention, after one or more lobbies on a given floor have become congested, the passenger arriving on an elevator is guided from the call input device to a less congested lobby.

According to another embodiment of the invention, in a group elevator system comprising double-door elevator cars, passengers are guided to the less congested lobby.

BRIEF DESCRIPTION OF THE DRAWING

In the following, the invention will be described in detail with reference to the attached drawings, wherein.

DESCRIPTION OF THE PREFERRED EMBODIMENTS

Figure 1:
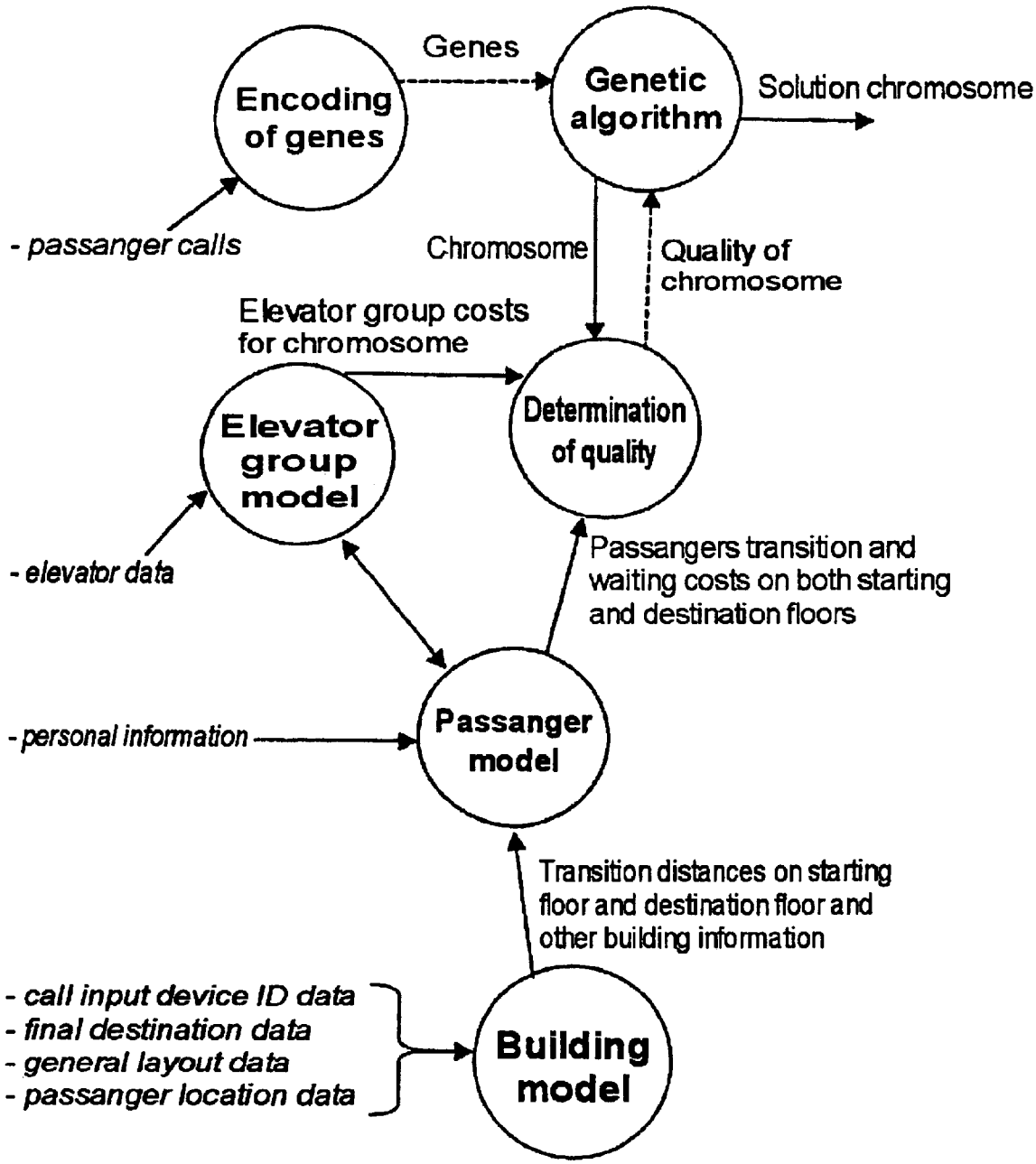
FIG. 1 illustrates the operation of genetic algorithms in lobby and door allocation according to the invention.

FIG. 1 illustrates the principle of the invention. To describe the operation of genetic algorithms in lobby and door allocation, a control system is presented that aims at finding the most suitable elevator door and lobby instead of the most suitable elevator car to serve the passenger. In this elevator control system, it is possible to search for an exit door that the passenger can advantageously use to leave the elevator car at the destination floor. The door and lobby allocation principle is applicable for use in elevator systems employing destination allocation.

In an elevator group control system applying door and lobby allocation according to the invention, by difference from a passenger algorithm, the gene value indicates the elevator door to serve the passenger. Assigning an elevator door instead of an elevator car makes it possible in a control system comprising multi-deck elevators to change the elevator car to serve the passenger even after the passenger has been told which elevator door is to serve him/her. According to one of the principles used in earlier elevator control systems, one of the cars of an elevator serves only the even floors of the building while the other one serves the odd floors. In the present control algorithm, by assigning a starting floor elevator door, it is possible to change the elevator car allocated to serve the passenger up to the moment when the elevator starts decelerating prior to stopping. In the case of a multi-deck elevator, the selection of an elevator car can be accomplished by means of the GA kernel as the data encoded in the chromosome includes, in addition to elevator door data, data indicating the elevator car to serve the passenger.

In the case of an elevator system comprising double-door elevator cars, the definitive assignment of the elevator door to serve the passenger at the destination floor can be decided just a moment before the elevator doors are opened at the destination floor. A double-door single-deck elevator is able to serve two lobbies on a floor simultaneously. Consequently, in the control system of double-door elevators, the passenger flow can be distributed more evenly between the lobbies on floors where the elevator has two landing doors available. In an elevator system based on destination allocation, the numbers of passengers in each lobby can be registered, so the passengers leaving a double-door elevator car can be guided to the less congested lobby if necessary. In addition to a more balanced distribution of passengers between elevator lobbies, the use of double-door elevator cars makes it possible to reduce the stopping time of the elevators at the floor.

In an elevator group control system applying lobby and door allocation according to the invention, a direction gene encoded in the gene determines the direction of departure of free elevators according to the passenger algorithm. An elevator group model determines the quality of each chromosome representing a solution alternative in respect of elevator group operation. The initial data used by the elevator group model consist of the elevator speeds, the sizes, positions and number of the elevator cars, rules of behavior of the elevators and information received from the passenger model. The passenger model in FIG. 1 defines the passenger transition and waiting costs both on the floors and in the elevator cars. The initial data for the model are obtained from a passenger register, the call input devices, external databases and the elevator group model. The initial data are utilized, among other things, for the determination of the space requirements and walking times of different persons.

In the process of forming the elevator routes in the elevator group model, the data produced by the passenger model, such as information regarding the persons' walking times and space requirements, are taken into account. From the initial data, the passenger model generates the walking times for persons walking from the place of the call input device to the target lobby or target elevator door. The passenger's final destination being known, it is possible to calculate the walking time from the destination floor elevator door to the final destination in the building.

The passenger model estimates the passengers' space requirements and moving speeds on the basis of personal data collected. By using personal data, it is possible to define passenger group data for the person. The members of a passenger group have e.g. similar transition and space requirements or destinations in the building. By using passenger type data, the passenger model can be simplified because utilizing the passenger type data makes it possible to avoid processing personal data for several people in the passenger model. Another aim of the use of passenger type data is to ensure that the persons belonging to a given group will receive similar service in the elevator system.

The space requirement of a member of a passenger group is taken into account in the formation of elevator routes in the elevator group model. In earlier methods, the number of passengers entering an elevator car is limited, among other things, on the basis of information provided by the car load weighing device. However, if consideration of the occupancy of an elevator car is limited to the use of a car load weighing device, this will result in unnecessary stops of the elevator because the light baggage carried by the passengers may quickly fill the elevator space. For example, a hotel customer carrying suitcases occupies more space in the elevator than the average traveler. Due to the various space requirements of elevator passengers, the space requirements of a given passenger group should be taken into account in the formation of elevator routes to avoid unnecessary stops of elevators. Floors passed by because of a lack of elevator space will be served at a later stage of the elevator route. When an elevator is passing by a floor, it is advisable to tell the persons waiting in the lobby beforehand via a lobby display that the elevator is going to pass by that floor, to ensure that those waiting will not interpret the by-pass as incorrect elevator operation.

In the formation of elevator routes in the elevator group model, the elevator door time or light-cell delay is not altered because unforeseen behavior of the elevator door would cause embarrassment. An exception to this is the case where no passengers are present in the elevator car. In this case, the elevator can wait longer than usual at the floor to allow passengers to enter the car. In other cases, when a passenger arrives too late at an elevator to be able to enter the car because the elevator door time has elapsed, the passenger will have to wait until the elevator arrives again. It is important to estimate the passenger transition times accurately to allow the passengers to catch the elevator cars intended for them.

In the elevator group control system of the invention based on door and lobby allocation, unlike a passenger algorithm, the gene value indicates the elevator door to serve the passenger. Assigning an elevator door instead of an elevator car makes it possible in a control system comprising multi-deck elevators to change the elevator car to serve the passenger even after the passenger has been told which elevator door is to serve him/her. According to one of the principles used in earlier elevator control systems, one of the cars of an elevator serves only the even floors of the building while the other one serves the odd floors. In the present control algorithm, assigning the starting floor elevator door makes it possible to change the elevator car allocated to serve the passenger up to the moment when the elevator starts decelerating prior to stopping. In the case of a multi-deck elevator, the selection of an elevator car can be accomplished by means of the GA kernel as the data encoded in the chromosome includes, in addition to elevator door data, data indicating the elevator car to serve the passenger.

In the case of an elevator system comprising double-door elevator cars, the definitive assignment of the elevator door to serve the passenger at the destination floor can be decided just a moment before the elevator doors are opened at the destination floor. A double-door single-deck elevator is able to serve two lobbies on a floor simultaneously. Consequently, in the control system of double-door elevators, the passenger flow can be distributed more evenly between the lobbies on floors where the elevator has two landing doors available. In an elevator system based on destination allocation, the numbers of passengers in each lobby can be registered, so the passengers leaving a double-door elevator car can be guided to the less congested lobby if necessary. In addition to a more balanced distribution of passengers between elevator lobbies, the use of double-door elevator cars makes it possible to reduce the stopping time of the elevators at the floor.

Figure 2:
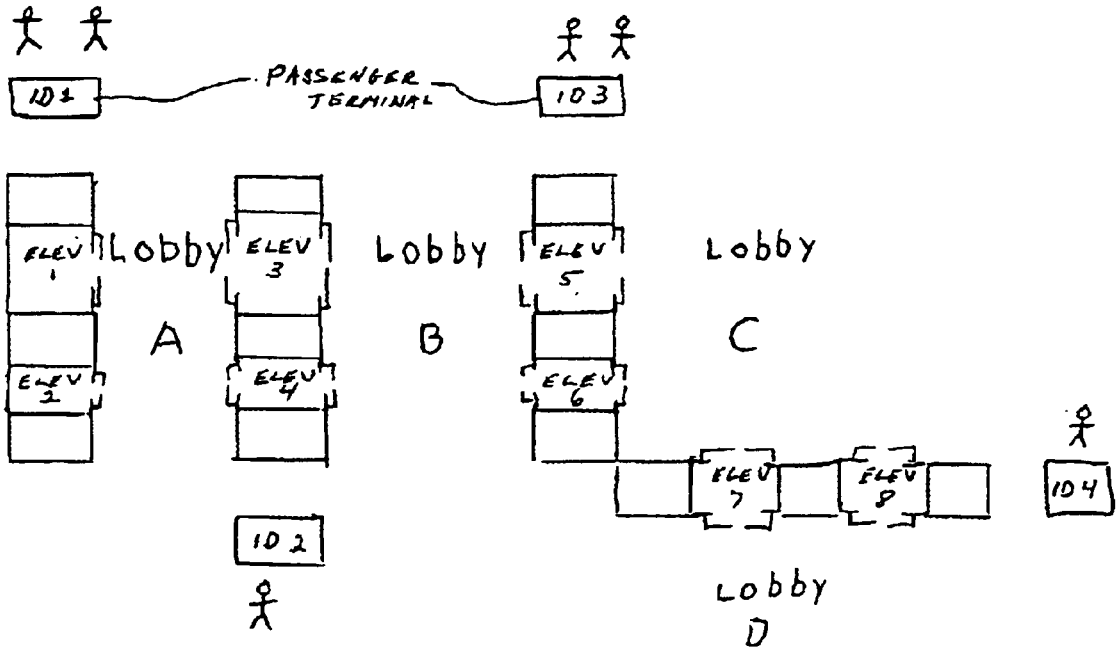
FIG. 2 illustrates the utilization of door and lobby allocation in an elevator system according to the invention.

The operation of control utilizing last-minute assignment of the destination floor elevator door is visualized by an example situation based on FIG. 2. In the example situation, a passenger is arriving at a floor on elevator 3 and simultaneously a passenger call has been entered from terminal "ID 1". In this situation, the elevator door best suited for the passenger call is the door of elevator 3 facing lobby A. In the example situation, when the number of times oil opening the elevator doors is minimized, the passenger arriving at the floor exits into lobby A, and into lobby B when the elevator stopping time is minimized. After one of the lobbies on the floor has become congested, the passenger arriving on the elevator can be guided to the less congested lobby, thus avoiding further congesting the already congested lobby by elevator control decisions.

In the elevator group control system of the invention, the number of route alternatives can also be determined when single-deck elevators are used. In the control system based on door and lobby allocation, besides the elevator routes, it is also necessary to determine the doors to serve the passengers on the starting and destination floors. In addition, the suitability of an elevator door for a passenger is established by using a passenger model as shown in FIG. 1. The use of two landing doors increases the number of potential passenger routes. The number of potential passenger routes in the elevator system reflects the difficulty of making good and reasonable control decisions in door and lobby allocation.

In the control algorithm, the elevator routes are formed on the basis of the hall calls issued. In control utilizing genetic algorithms, unallocated hall calls are taken into account in the generation of chromosomes containing genes, i.e. of elevator route alternatives. In door and lobby allocation, the position of the gene in the chromosome specifies the passenger or the passenger group, at least some of the initial data for the members of the group being similar to each other.

In the elevator group control system of the invention based on door and lobby allocation, the number of passenger calls to be considered in the encoding of genes is determined both from the manner and instant of assignment of passenger routes and from the instant of assignment of elevator routes. As a result of instant decisions regarding the elevator door and car to serve the passenger, the number of calls to be taken into account in an elevator control decision remains small. A last-minute decision regarding the elevator door to serve the passenger increases the number of passenger calls to be considered in elevator control and makes it mathematically more difficult to make control decisions. Control decisions made at the last minute are adapted to changes in the control system because the decision regarding the elevator to serve the passenger can be changed even until the elevator reaches the deceleration point. In the elevator group control system of the invention based on door and lobby allocation, the control decisions are improved by delaying the assignment of the elevator door and car to serve the passenger if the passenger is at first only informed via a hall call input device placed in the elevator lobby.

After the destination lobby has been assigned, the number of elevators suited to serve the hall call is reduced if the elevators of more than one lobbies are suited to serve the passenger call. In this case, the number of elevator routes to be examined in the control system is significantly reduced. In the elevator group control system of the invention based on door and lobby allocation, personal hall calls again increase the number of elevator and passenger routes to be considered. In the elevator group control system of the invention based on door and lobby allocation, some of the computing time is used on determining the destination lobby for the passenger if several elevator lobbies are able to serve the passenger call. The number of elevator calls to be taken into account in the control decision making process is also dependent on the locations of the call input devices in the system if the destination elevator door is only assigned after the passenger has arrived in the lobby.

FIG. 2 visualizes the utilization of door and lobby allocation in an elevator system according to the invention.

Destination allocation makes it unnecessary for the passengers to know the destination floors served by the elevators because the control system tells the passenger on the floor which elevator is going to serve him/her, by informing the passenger as to the elevator allocated to serve him/her according to immediate allocation. In the present invention, the passenger does not have to know which destination floors are served by each elevator; instead, the control system takes care that the right elevator is offered to the passenger if the elevator journey consists of several stages and stops at different floors. As is known, the aforesaid sky lobby floors are traditionally used for changes of elevators. According to the present invention, unlike prior art, an arrangement is proposed wherein the passenger is informed immediately in connection with the terminal call as to which lobby is to serve him/her and the elevator door assigned to serve the passenger may be indicated to him/her later in the lobby serving him/her.

Lobby allocation makes it easier to find the destination elevator door in large elevator systems, as is visualized in the following FIG. 2. The example illustration presents a system of eight elevators. Of these elevators on this floor, elevators 3–8 are double-door while elevators 1 and 2 are single-door elevators. The elevator cars may be single-deck or multi-deck types. A passenger can be guided from terminal "ID 1" (passenger terminal) to the distant lobby C more easily than to the door of elevator 6 on the side of lobby C.

What is claimed is:

1. Method for the allocation of passengers in an elevator group comprising the steps of:

providing several elevator lobbies and multi-door elevators, each passenger giving his/her destination floor by a call input device, defining the passenger's starting and destination floors thereby allocating an elevator lobby first in connection with the passenger's destination floor call, then allocating an elevator door.

2. Method according to claim 1, wherein if the passenger is to be served by a multi-deck elevator car, the elevator to serve the passenger's call is allocated after the allocation of the elevator door.

3. Method according to claim 1 or 2, wherein the passenger is allocated to an elevator car to serve him/her by a heuristic method or by a genetic allocation method, in such manner that elevator routes are encoded into alternative chromosomes, required data regarding the elevator lobbies and elevator doors and elevator cars for the passenger being stored in a gene of the chromosome, that utilizing genetic methods, alternative chromosomes are developed and the best one among these is selected, and that the passengers indicated by the best chromosome are guided to the elevator lobbies and elevator doors and elevator cars represented by this chromosome, and that the elevator lobbies and elevator doors and elevator cars indicated by the best chromosome are caused to serve the passengers stored on said chromosome.

4. Method according to claim 3, wherein the chromosomes are so formed that the position of the gene in the chromosome defines the identity of the passenger, and the value or allele of the gene defines the elevator lobby and elevator door and elevator car to serve the passenger.

5. Method according to claim 3, wherein the gene contains several allele alternatives as long as the genetic algorithm is running.

6. Method according to claim 3, wherein the elevator lobbies and elevator doors and elevator cars assigned to passengers during previous allocation cycles are stored on a chromosome as genes whose allele is unchangeable and represents the elevator lobby and elevator door and elevator car already allocated to the passenger.

7. Method according to claim 3, wherein the genetic allocation is performed in a GA kernel, from which an executive unit obtains the elevator lobby and elevator door and elevator car selected for the passenger, who will be guided as a passenger allocated to an elevator having this elevator lobby and elevator door and elevator car.

8. Method according to claim 3, wherein after the genetic algorithm has stopped, the executive unit calls a decoding function, whereby the elevator lobbies and elevator doors and elevator cars indicated by the best chromosome are obtained from the GA kernel, to be entered into the elevator data fields for unallocated passengers.

9. Method according to claim 3, wherein two or more passengers can be handled together by a single passenger group gene.

10. Method according to claim 1, wherein after one or more lobbies on a given floor have become congested, the passenger arriving on an elevator is guided from the call input device to a less congested lobby.

11. Method according to claim 1, wherein in a group elevator system comprising double-door elevator cars, passengers are guided to the less congested lobby.

* * * * *